US009913037B2

(12) United States Patent
Suzuki et al.

(10) Patent No.: US 9,913,037 B2
(45) Date of Patent: Mar. 6, 2018

(54) ACOUSTIC OUTPUT DEVICE

(71) Applicant: SONY CORPORATION, Tokyo (JP)

(72) Inventors: Junya Suzuki, Kanagawa (JP); Toshiyuki Nakagawa, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/124,712

(22) PCT Filed: Feb. 23, 2015

(86) PCT No.: PCT/JP2015/055087

§ 371 (c)(1),
(2) Date: Sep. 9, 2016

(87) PCT Pub. No.: WO2015/141402

PCT Pub. Date: Sep. 24, 2015

(65) Prior Publication Data

US 2017/0026751 A1 Jan. 26, 2017

(30) Foreign Application Priority Data

Mar. 19, 2014 (JP) ..... 2014-056280

(51) Int. Cl.
*H04R 3/12* (2006.01)
*H04R 5/033* (2006.01)
(Continued)

(52) U.S. Cl.
CPC ..... *H04R 5/033* (2013.01); *H04R 3/12* (2013.01); *H04R 25/606* (2013.01); *H04S 3/004* (2013.01);
(Continued)

(58) Field of Classification Search
CPC ... H04R 1/00; H04R 1/10; H04R 3/00; H04R 5/033; H04S 3/00; H04S 5/02
(Continued)

(56) References Cited

U.S. PATENT DOCUMENTS

2008/0112581 A1* 5/2008 Kim ..... H04R 1/1075 381/151
2013/0051585 A1* 2/2013 Karkkainen ..... H04R 1/1075 381/151

FOREIGN PATENT DOCUMENTS

JP 3174965 U 4/2012

OTHER PUBLICATIONS

JP3174965U; Sato; Apr. 19, 2012.*
(Continued)

*Primary Examiner* — Melur Ramakrishnaiah
(74) *Attorney, Agent, or Firm* — Chip Law Group

(57) ABSTRACT

[Object] To provide an acoustic output device capable of reproducing a more natural stereophonic sound giving a realistic sensation regardless of the influence of individual differences in the shapes of ears or an imperfection of the recording system or the reproducing system, through a combination of an air conduction sound and a bone conduction sound produced through bone conduction. [Solution] Provided is an acoustic output device including: an air conduction sound providing unit configured to provide an air conduction sound; and a bone conduction sound providing unit configured to provide a bone conduction sound. The bone conduction sound providing unit is positioned on a portion other than near an ear of a user when worn by the user. According to the an acoustic output device, it is possible to reproduce a stereophonic sound regardless of the influence of individual differences in the shapes of ears or an imperfection of the recording system or the reproducing system.

15 Claims, 13 Drawing Sheets

(51) Int. Cl.
*H04R 25/00* (2006.01)
*H04S 3/00* (2006.01)
*H04S 5/00* (2006.01)

(52) U.S. Cl.
CPC ..... *H04S 5/005* (2013.01); *H04R 2460/13* (2013.01); *H04S 2420/01* (2013.01)

(58) Field of Classification Search
USPC ..... 381/309, 312, 151
See application file for complete search history.

(56) References Cited

OTHER PUBLICATIONS

International Search Report and Written Opinion of PCT Application No. PCT/JP2015/055087, dated Mar. 31, 2015, 5 pages of English Translation and 7 pages of ISRWO.
International Preliminary Report on Patentability of PCT Application No. PCT/JP2015/055087, dated Sep. 20, 2016, pp. 4.

* cited by examiner

ACOUSTIC OUTPUT DEVICE

CROSS REFERENCE TO RELATED APPLICATIONS

This application is a U.S. National Phase of International Patent Application No. PCT/JP2015/055087 filed on Feb. 23, 2015, which claims priority benefit of Japanese Patent Application No. 2014-056280 filed in the Japan Patent Office on Mar. 19, 2014. Each of the above-referenced applications is hereby incorporated herein by reference in its entirety.

TECHNICAL FIELD

The present disclosure relates to an acoustic output device.

BACKGROUND ART

With the development of processing capabilities of processors such as digital signal processors (DSPs), it has become possible to reconstruct spatial expansion at the time of acoustic listening using a headphone by convoluting an audio signal with a head-related transfer function (HRTF).

For example, Patent Literature 1 discloses a method of improving space perception in virtual surround to prevent reproducibility of a front channel from being damaged while improving reproducibility of surround channels by a pair of loudspeakers. Further, Patent Literature 2 discloses a technique for localizing an audio image outside the head of the user through an audio signal convoluted with an average HRTF.

CITATION LIST

Patent Literature

Patent Literature 1: JP 2005-513892A
Patent Literature 2: JP 2000-138998A

SUMMARY OF INVENTION

Technical Problem

However, in the existing headphone system, it is difficult to sufficiently localize the audio image outside the head of the user, and the audio image instead feels as if it is stuck to the head of the user. The audio image is not sufficiently localized outside the head of the user due to individual differences in the shapes of ears or heads between the users or an imperfection of a recording system or a reproducing system. There is a demand for a system capable of sufficiently localizing the audio image outside the head of the user regardless of such individual differences or imperfections.

In this regard, in the present disclosure, proposed is an acoustic output device, which is novel and improved and capable of reproducing a more natural stereophonic sound giving a realistic sensation regardless of the influence of individual differences in the shapes of ears or an imperfection of the recording system or the reproducing system, through a combination of an air conduction sound and a bone conduction sound produced through bone conduction.

Solution to Problem

According to the present disclosure, there is provided an acoustic output device including: an air conduction sound providing unit configured to provide an air conduction sound; and a bone conduction sound providing unit configured to provide a bone conduction sound. The bone conduction sound providing unit is positioned on a portion other than near an ear of a user when worn by the user.

Advantageous Effects of Invention

As described above, according to the present disclosure, it is possible to provide an acoustic output device, which is novel and improved and capable of reproducing a more natural stereophonic sound giving a realistic sensation regardless of the influence of individual differences in the shapes of ears or an imperfection of the recording system or the reproducing system, through a combination of an air conduction sound and a bone conduction sound produced through bone conduction.

Note that the effects described above are not necessarily limited, and along with or instead of the effects, any effect that is desired to be introduced in the present specification or other effects that can be expected from the present specification may be exhibited.

DESCRIPTION OF EMBODIMENT(S)

Figure 1:
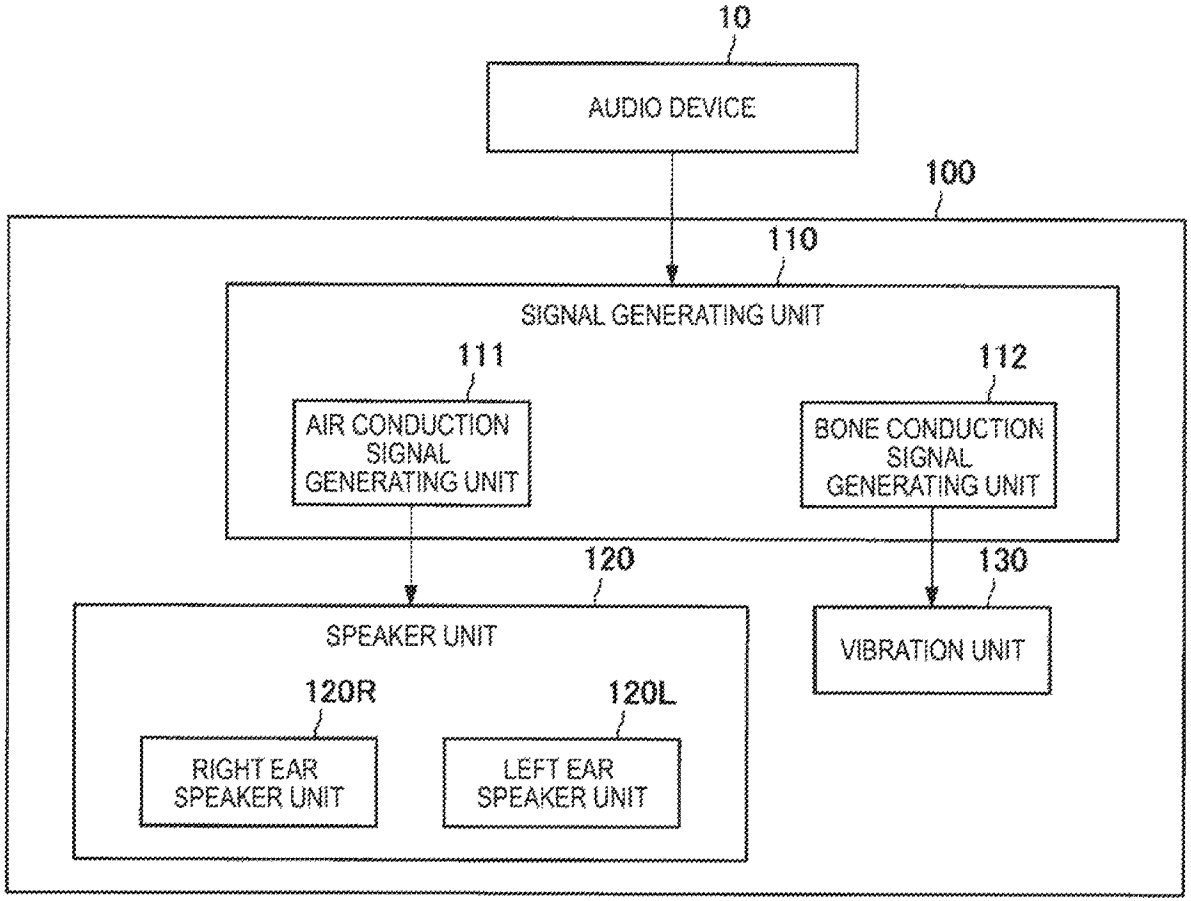
FIG. 1 is an explanatory diagram illustrating an exemplary functional configuration of a headphone system 100 according to an embodiment of the present disclosure.

Hereinafter, (a) preferred embodiment(s) of the present disclosure will be described in detail with reference to the appended drawings. In this specification and the drawings, elements that have substantially the same function and structure are denoted with the same reference signs, and repeated explanation is omitted.

The description will proceed in the following order:

1. Embodiment of present disclosure 1.1. Overview 1.2. Exemplary functional configuration of headphone system 1.3. Exemplary audio image localization by headphone system 2. Conclusion

1. Embodiment of Present Disclosure

[1.1. Overview]

First, an overview of a headphone system according to an embodiment of the present disclosure will be described. The headphone system according to an embodiment of the present disclosure to be described below is an exemplary acoustic output device of the present disclosure, and includes a speaker unit that provides an air conduction sound and a vibration unit that provides a bone conduction sound as will be described later. The air conduction sound is a sound that directly reaches both human ears. The bone conduction sound is a sound that reaches the ears through the inside of the human body.

In the headphone system that provides the user with only the air conduction sound or the bone conduction sound, when a sound is physically changed or when signal processing is performed on only the air conduction sound or the bone conduction sound, it is difficult to sufficiently localize the audio image outside the head of the user, and the audio image feels as if it is stuck to the head of the user. Thus, in the headphone system that provides the user with only the air conduction sound or the bone conduction sound, it is difficult to provide the user with a sound giving a realistic sensation by sufficiently localizing the audio image outside the head.

It is known that if the shape of the auricle changes or the ear canal is blocked, sound source localization is significantly damaged and a sound can hardly be sensed. Humans are said to be good at perceiving a direction or a distance of a sound source using both ears and determining a distance or a direction by moving their head, but even when it is difficult to move the head or one ear is blocked, the direction or distance of a sound source can still be determined (Yoshio Yamazaki, "Hearing and Audio," JAS Journal, Volume 93 Issue 6, p11).

In this regard, in the headphone system according to an embodiment of the present disclosure, the realistic sensation is further improved without depending on complicated signal processing by providing the bone conduction sound that reaches the ear through the inside of the human body in addition to the air conduction sound that directly reaches both of the human's ears.

The overview of the headphone system according to an embodiment of the present disclosure has been described above. Next, an exemplary functional configuration of the headphone system according to an embodiment of the present disclosure will be described.

[1.2. Exemplary Functional Configuration of Headphone System]

FIG. 1 is an explanatory diagram illustrating an exemplary functional configuration of a headphone system 100 according to an embodiment of the present disclosure. An exemplary functional configuration of the headphone system 100 according to an embodiment of the present disclosure will be described below with reference to FIG. 1.

The headphone system 100 according to an embodiment of the present disclosure illustrated in FIG. 1 is an exemplary acoustic output device of the present disclosure. As illustrated in FIG. 1, the headphone system 100 according to an embodiment of the present disclosure includes a signal generating unit 110, a speaker unit 120, and a vibration unit 130.

The signal generating unit 110 generates an audio signal to be output to the speaker unit 120 and an audio signal to be output to the vibration unit 130 using an audio signal output from an audio device 10 connected to the headphone system 100. For example, the signal generating unit 110 may be configured with a DSP. As illustrated in FIG. 1, the signal generating unit 110 includes an air conduction signal generating unit 111 and a bone conduction signal generating unit 112. The air conduction signal generating unit 111 generates the audio signal (air conduction signal) to be output to the speaker unit 120 using the audio signal output from the audio device 10. The bone conduction signal generating unit 112 generates the audio signal (bone conduction signal) to be output to the vibration unit 130 using the audio signal output from the audio device 10.

The headphone system 100 may be connected with the audio device 10 in a wired manner or a wireless manner. The audio signal output from the audio device 10 to the headphone system 100 may be a 2-channel stereophonic audio signal or may be a 5.1- or 7.1-channel surround audio signal or the like.

The speaker unit 120 provides the user with the air conduction sound. In the present embodiment, the speaker unit 120 includes a right ear speaker unit 120R worn on the right ear of the user and a left ear speaker unit 120L worn on the left ear of the user. The speaker unit 120 is worn on the left and right ears of the user and thus can provide the user with the air conduction sound through the right ear speaker unit 120R and the left ear speaker unit 120L based on the audio signal output from the signal generating unit 110.

The vibration unit 130 provides the user with the bone conduction sound. The vibration unit 130 is worn, for example, on the head of the user and thus can provide the user with the bone conduction sound based on the audio signal output from the signal generating unit 110. The vibration unit 130 may be installed to be positioned on a portion other than a portion near a position of the ear of the user when the headphone system 100 is worn by the user. The number of vibration units 130 may be one or more. If the number of vibration units 130 is one, the vibration unit 130 may be installed to be positioned, for example, on the forehead of the user when the headphone system 100 is worn by the user. If the number of vibration units 130 is two, the vibration units 130 are installed to be positioned, for example, near the left and right temples of the user when the headphone system 100 is worn by the user.

The signal generating unit 110 controls an amplitude, a phase, and frequency characteristics when the air conduction signal and the bone conduction signal are generated through the air conduction signal generating unit 111 and the bone conduction signal generating unit 112. The speaker unit 120 and the vibration unit 130 are considered to be installed so that the vibration unit 130 is positioned in front of the speaker unit 120 when the headphone system 100 is worn by the user. In this case, the signal generating unit 110 adjusts output timings of a sound output from the vibration unit 130 and a sound output from the speaker unit 120 when the air conduction signal and the bone conduction signal are generated through the air conduction signal generating unit 111 and the bone conduction signal generating unit 112. For example, the signal generating unit 110 performs a process of delaying the sound output from the speaker unit 120 to be a predetermined time later than the sound output from the vibration unit 130 when the air conduction signal and the bone conduction signal are generated through the air conduction signal generating unit 111 and the bone conduction signal generating unit 112. As described above, by performing the process of delaying the sound output from the speaker unit 120 to be a predetermined time later than the sound output from the vibration unit 130, the headphone system 100 according to an embodiment of the present disclosure can localize the audio image in front of the outside of the head of the user.

When the audio signal supplied from the audio device 10 is the 2-channel stereophonic audio signal, the air conduction signal generating unit 111 and the bone conduction signal generating unit 112 can generate the signals by which the same sound is output from the speaker unit 120 and the vibration unit 130. Further, when the audio signal supplied from the audio device 10 is the 5.1- or 7.1-channel surround audio signal or the like, the air conduction signal generating unit 111 and the bone conduction signal generating unit 112 can generate the signals so that a surround audio of 5.1 channels, 7.1 channels, or the like can be implemented through the sounds provided from the speaker unit 120 and the vibration unit 130.

The signal generating unit 110 may set, for example, about 10 ms (milliseconds) as a time for which the sound output from the speaker unit 120 is delayed to be later than the sound output from the vibration unit 130. The delay time from the signal generating unit 110 may be decided in view of an interaural time difference (ITD) or an interaural level difference (ILD).

The ITD is dominated by a low frequency component that goes around the head. A distance between both human ears is about 150 mm, and about ±700 μs (microseconds) obtained by dividing a geodesic distance 236 mm between both ears obtained by multiplying the distance between both human ears by π by the sound velocity (about 340 m/s) is a maximum value of the ITD.

The ILD typically refers to a power difference between left and right channel signal waveforms of a sound that is binaurally collected or a sound pressure difference of the entire signal calculated from a difference in an amplitude spectrum of the HRTF. The ILD is dominated by a high frequency component that is shielded by the head. A maximum value of the ILD of humans is about ±16 dB.

On the other hand, the signal generating unit 110 may perform a process of delaying the sound output from the vibration unit 130 to be a predetermined time later than the sound output from the speaker unit 120 when the air conduction signal and the bone conduction signal are generated through the air conduction signal generating unit 111 and the bone conduction signal generating unit 112. As described above, by performing the process of delaying the sound output from the vibration unit 130 to be a predetermined time later than the sound output from the speaker unit 120, the headphone system 100 according to an embodiment of the present disclosure can localize the audio image behind the outside of the head of the user.

Further, the signal generating unit 110 may generate a bone conduction signal convoluted with coefficients for localizing the audio image in front of, behind, above, and below the user when the air conduction signal and the bone conduction signal are generated through the air conduction signal generating unit 111 and the bone conduction signal generating unit 112. The coefficients may be generated, for example, using a technique disclosed in JP 2000-138998A or the like. JP 2000-138998A discloses a technique of converting an audio signal for stereophonic reproduction into an audio signal for binaural reproduction. Coefficient values that are multiplied by a coefficient multiplier of a digital filter are set based on measured values of impulse responses of two systems from a sound source to the left and right ears of a listener. As the bone conduction signal convoluted with the coefficients for localizing the audio image in front of, behind, above, and below the user is generated as described above, the headphone system 100 can localize the audio image in front of, behind, above, and below the outside of the head of the user.

The signal generating unit 110 may perform either of the above-described delay process and the process of generating the bone conduction signal convoluted with the coefficients or may perform a combination of the two processes.

As described above, the headphone system 100 according to an embodiment of the present disclosure can cause a sound to be provided to have a back and forth or up and down positional relation by transferring sounds having different paths such as the air conduction sound and the bone conduction sound to the user with a time difference, a strength difference, and a spectrum difference.

[1.3. Exemplary Audio Image Localization of the Headphone System]

Figure 2:
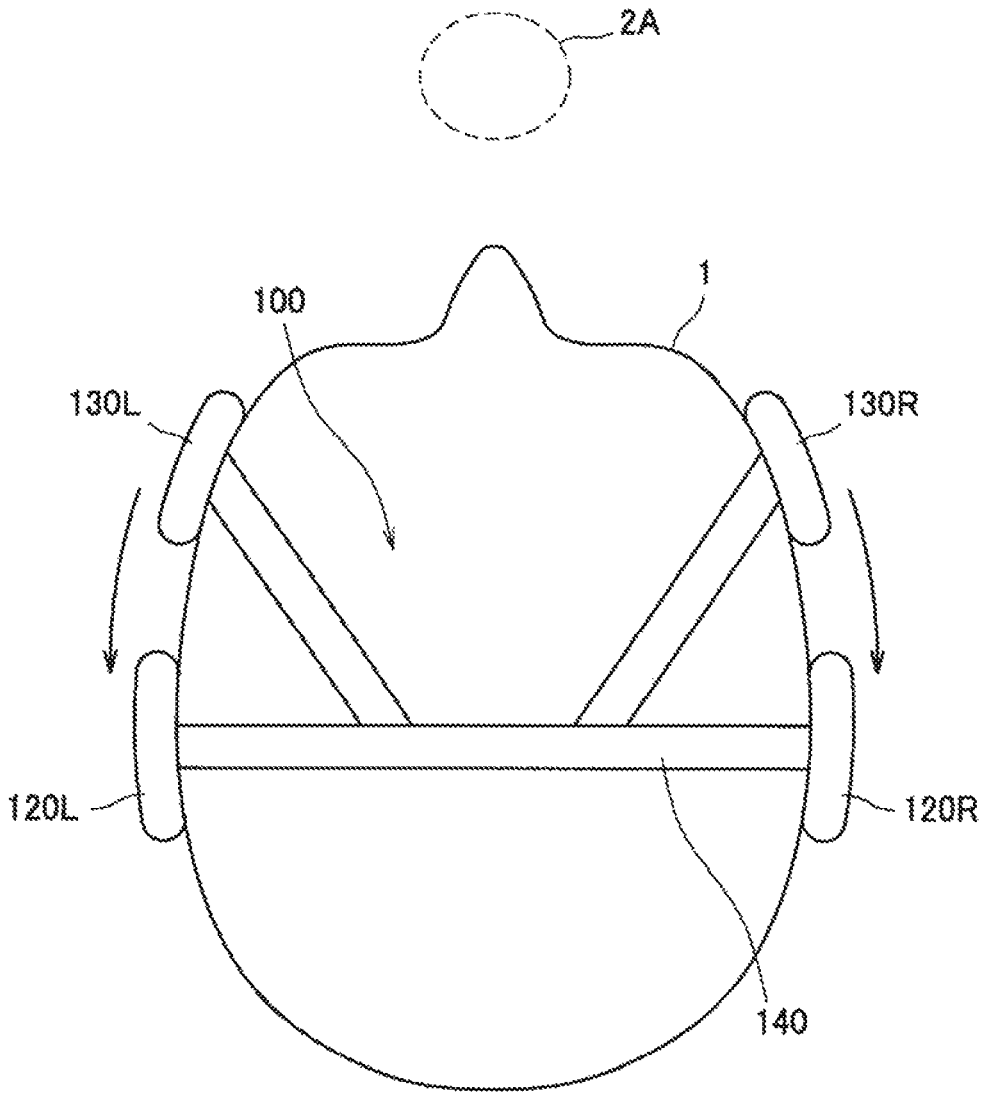
FIG. 2 is an explanatory diagram schematically illustrating a state in which the headphone system 100 is worn by a user 1 when the user 1 is viewed from above.

Next, exemplary audio image localization by the speaker unit 120 and the vibration unit 130 will be described. FIG. 2 is an explanatory diagram schematically illustrating the state in which the headphone system 100 is worn by a user 1 when the user 1 is viewed from above. FIG. 2 schematically illustrates a state in which the speaker units 120R and 120L are worn on both ears of the user 1, and the vibration units 130R and 130L are worn on portions (for example, near the temples) in front of the ears of the user 1. The speaker units 120R and 120L and the vibration units 130R and 130L are connected to a headband portion 140. The audio signal output from the audio device 10 to the headphone system 100 is assumed to be the 2-channel stereophonic audio signal.

The signal generating unit 110 performs a process of delaying the sound output from the speaker units 120R and 120L to be a predetermined time later than the sound output from the vibration units 130R and 130L as indicated by arrows in FIG. 2. As illustrated in FIG. 2, by delaying the sound output from the speaker units 120R and 120L to be a predetermined time later than the sound output from the vibration units 130R and 130L in the state in which the headphone system 100 is worn by the user 1, the headphone system 100 can localize the audio image outside the head of the user 1, for example, at a position indicated by a reference numeral 2A.

Figure 3:
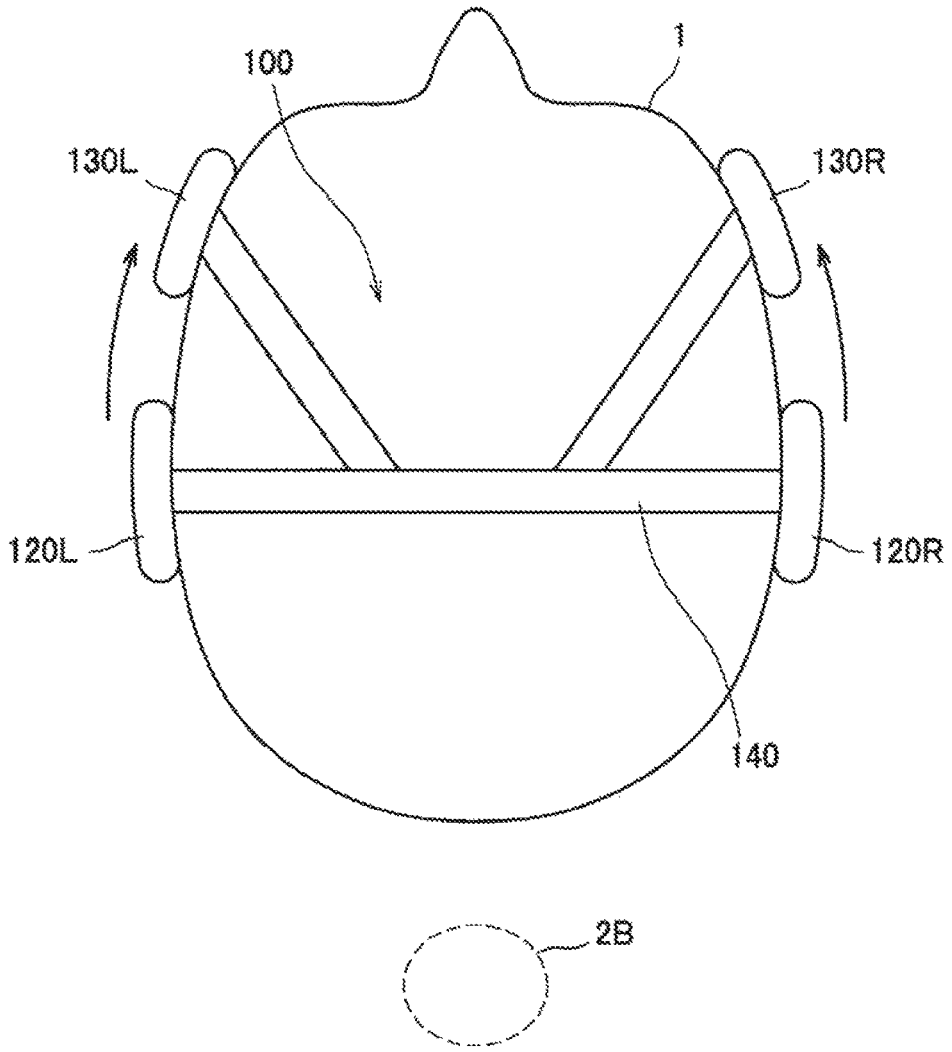
FIG. 3 is an explanatory diagram schematically illustrating a state in which the headphone system 100 is worn by a user 1 when the user 1 is viewed from above.

Another example of audio image localization by the speaker unit 120 and the vibration unit 130 will be described. FIG. 3 is an explanatory diagram schematically illustrating the state in which the headphone system 100 is worn by the user 1 when the user 1 is viewed from above. FIG. 3 schematically illustrates a state in which the speaker units 120R and 120L are worn on both ears of the user 1, and the vibration units 130R and 130L are worn on portions (for example, near the temples) in front of the ears of the user 1, similarly to FIG. 2. The speaker units 120R and 120L and the vibration units 130R and 130L are connected to the headband portion 140.

The signal generating unit 110 performs a process of delaying the sound output from the vibration units 130R and 130L to be a predetermined time later than the sound output from the speaker units 120R and 120L as indicated by arrows in FIG. 3. As illustrated in FIG. 3, by delaying the sound output from the vibration units 130R and 130L to be a predetermined time later than the sound output from the speaker units 120R and 120L in the state in which the headphone system 100 is worn by the user 1, the headphone system 100 can localize the audio image outside the head of the user 1, for example, at a position indicated by a reference numeral 2B.

FIGS. 2 and 3 illustrate the example in which the two vibration units 130 are installed, but even when only one vibration unit 130 is installed, it is similarly possible to localize the audio image outside the head of the user 1.

Figure 4:
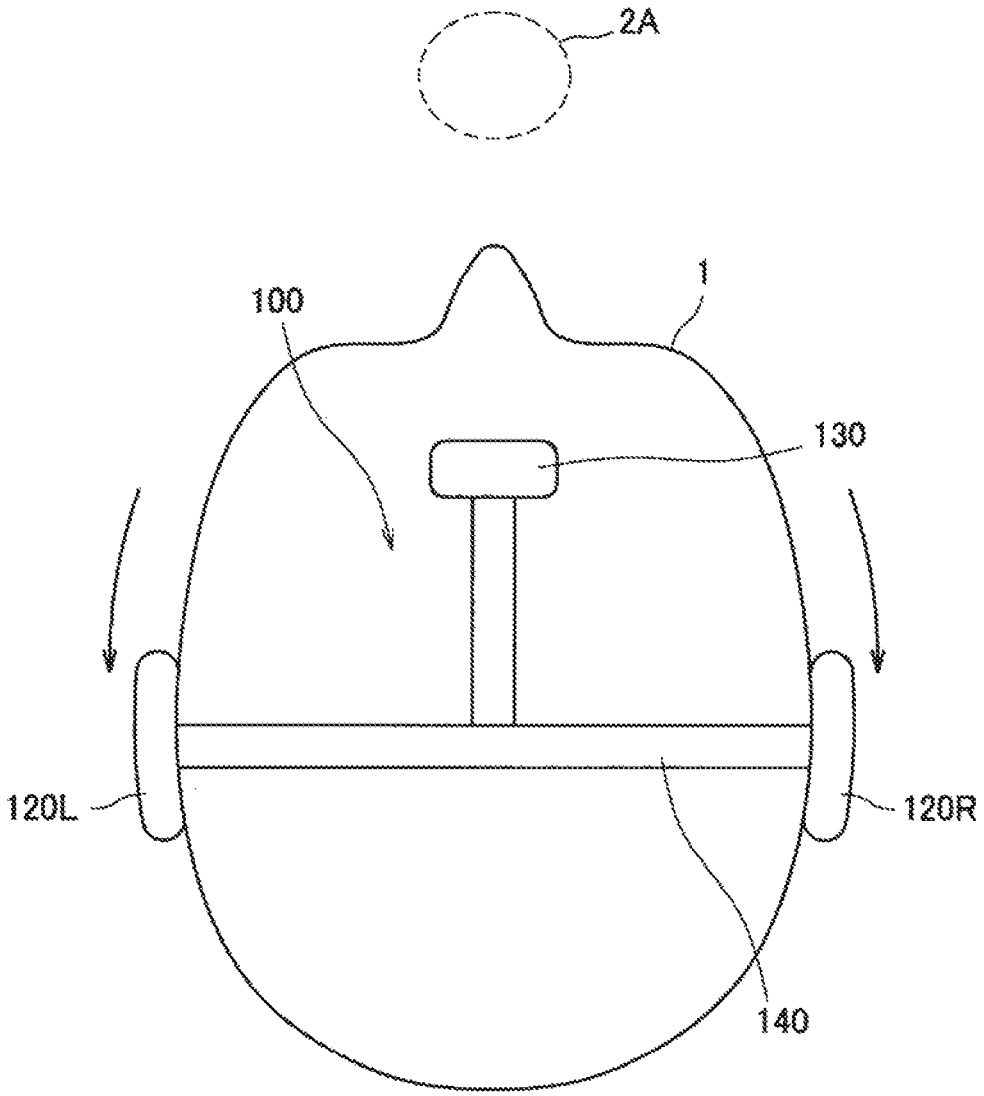
FIG. 4 is an explanatory diagram schematically illustrating a state in which the headphone system 100 is worn by a user 1 when the user 1 is viewed from above.

FIG. 4 is an explanatory diagram schematically illustrating the state in which the headphone system 100 is worn by the user 1 when the user 1 is viewed from above. FIG. 4 schematically illustrates a state in which the speaker units 120R and 120L are worn on both ears of the user 1, and the vibration unit 130 is worn on a portion (for example, near the forehead) in front of the ears of the user 1. The speaker units 120R and 120L and the vibration unit 130 are connected to the headband portion 140.

The signal generating unit 110 performs a process of delaying the sound output from the speaker units 120R and 120L to be a predetermined time later than the sound output from the vibration unit 130 as indicated by arrows in FIG. 4. As illustrated in FIG. 4, by delaying the sound output from the speaker units 120R and 120L to be a predetermined time later than the sound output from the vibration unit 130 in the state in which the headphone system 100 is worn by the user 1, the headphone system 100 can localize the audio image outside the head of the user 1, for example, at a position indicated by a reference numeral 2A.

Figure 5:
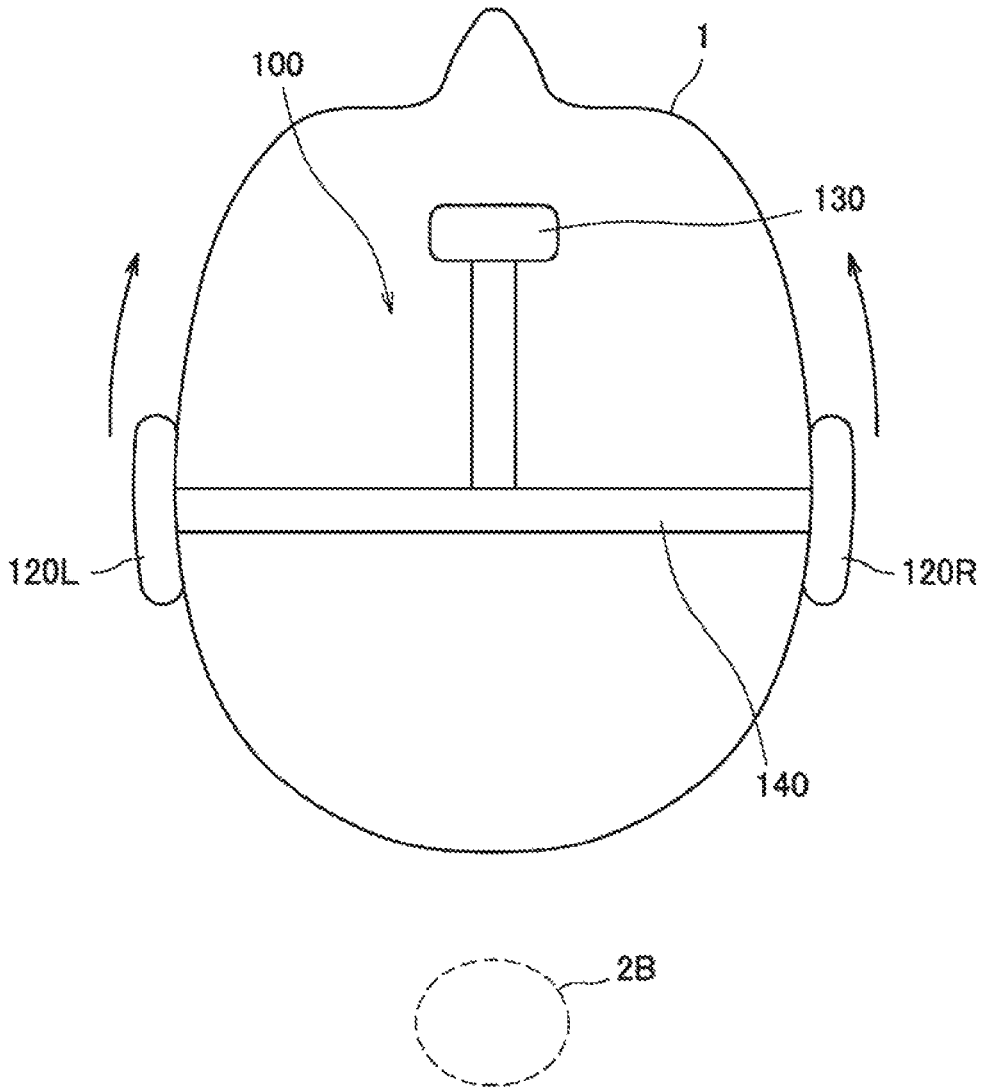
FIG. 5 is an explanatory diagram schematically illustrating a state in which the headphone system 100 is worn by a user 1 when the user 1 is viewed from above.

Another example of audio image localization by the speaker unit 120 and the vibration unit 130 will be described. FIG. 5 is an explanatory diagram schematically illustrating the state in which the headphone system 100 is worn by the user 1 when the user 1 is viewed from above. FIG. 5 schematically illustrates a state in which the speaker units 120R and 120L are worn on both ears of the user 1, and the vibration unit 130 is worn on a portion (for example, near the forehead) in front of the ears of the user 1, similarly to FIG. 4. The speaker units 120R and 120L and the vibration unit 130 are connected to the headband portion 140.

The signal generating unit 110 performs a process of delaying the sound output from the vibration unit 130 to be a predetermined time later than the sound output from the speaker units 120R and 120L as indicated by arrows in FIG. 5. As illustrated in FIG. 5, by delaying the sound output from the vibration unit 130 to be a predetermined time later than the sound output from the speaker units 120R and 120L in the state in which the headphone system 100 is worn by the user 1, the headphone system 100 can localize the audio image outside the head of the user 1, for example, at a position indicated by a reference numeral 2B.

In FIGS. 2 to 5, the examples of the audio image localization position by the headphone system 100 are illustrated using the schematic drawings when the user 1 is viewed from above. Next, examples of the audio image localization position by the headphone system 100 will be described with reference to schematic drawings when the user 1 is viewed from the side.

Figure 6:
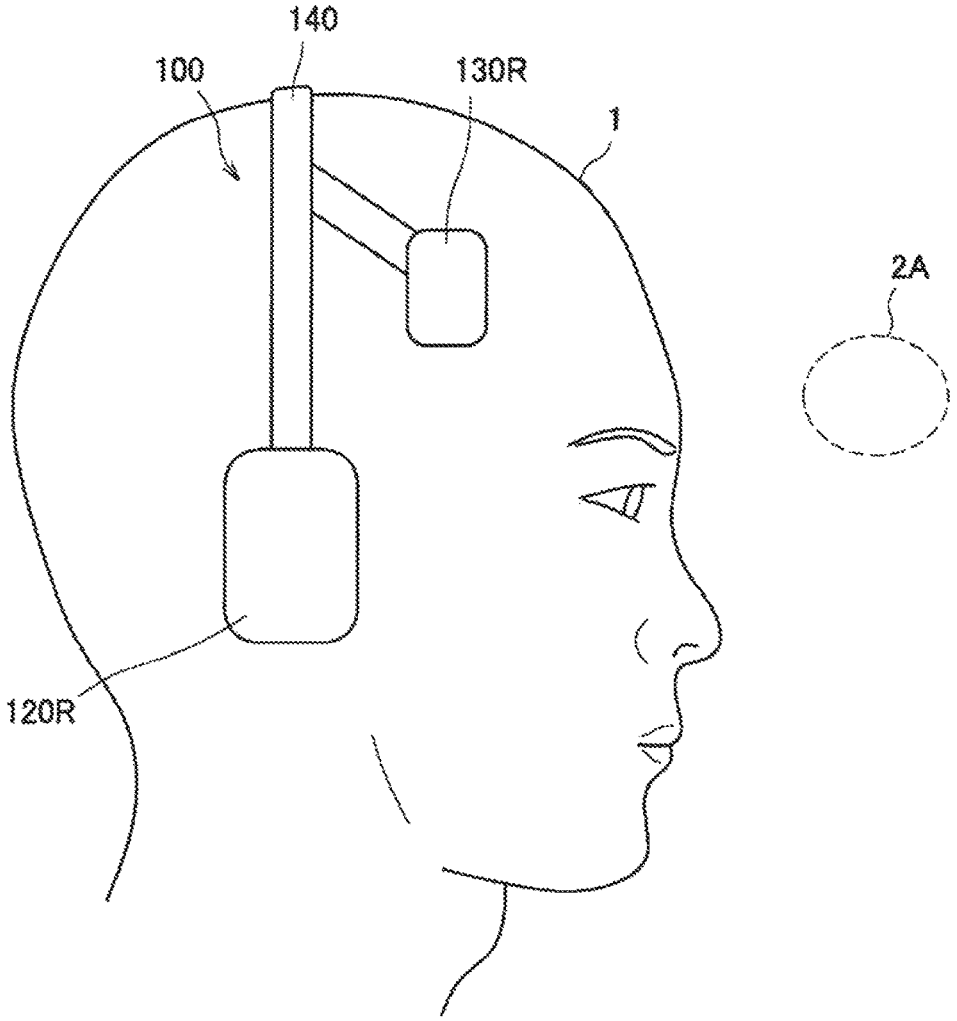
FIG. 6 is an explanatory diagram schematically illustrating a state in which the headphone system 100 is worn by the user 1 when the user 1 is viewed from the right.
Figure 7:
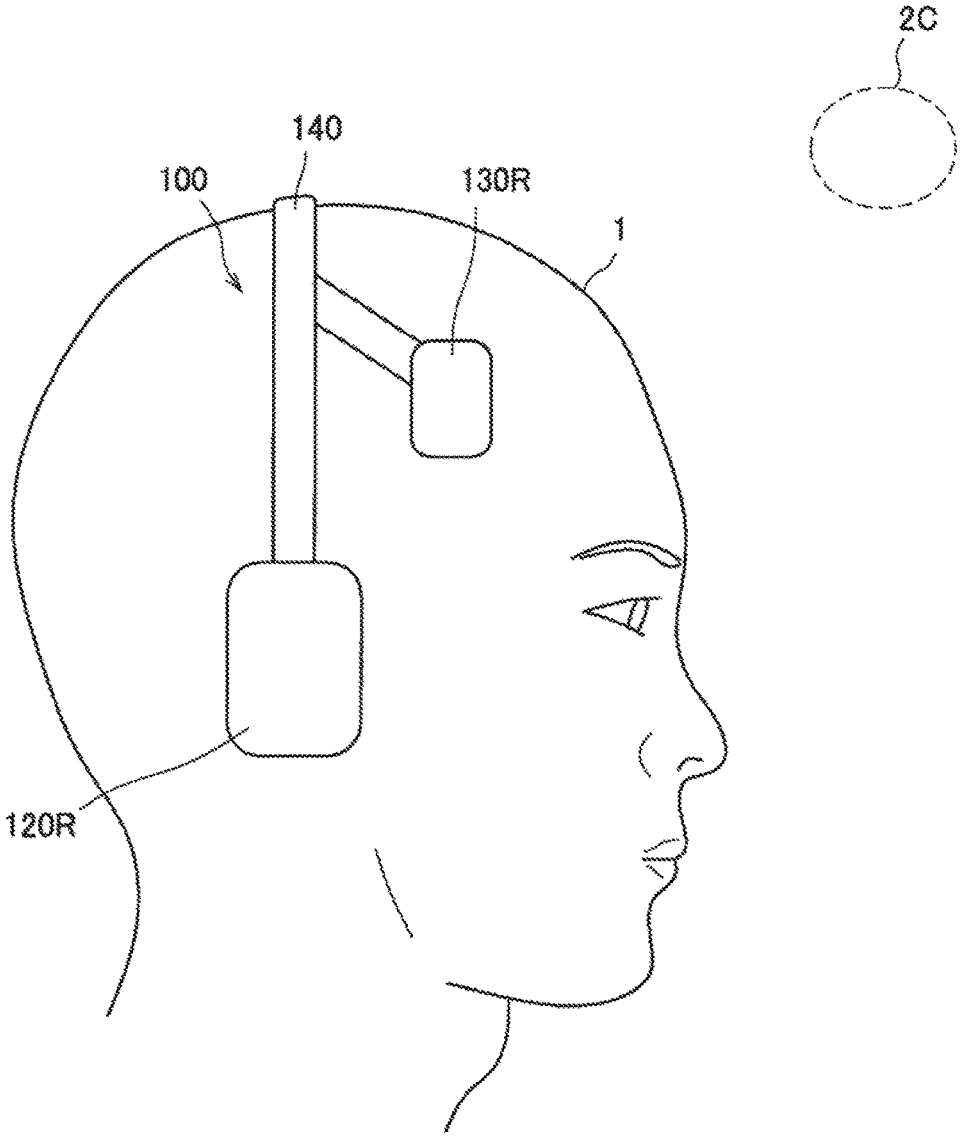
FIG. 7 is an explanatory diagram schematically illustrating a state in which the headphone system 100 is worn by the user 1 when the user 1 is viewed from the right.

FIGS. 6 and 7 are explanatory diagrams schematically illustrating a state in which the headphone system 100 is worn by the user 1 when the user 1 is viewed from the right. FIGS. 6 and 7 schematically illustrate a state in which the speaker unit 120R is worn on the right ear of the user 1, and the vibration unit 130R is worn on a portion (for example, near the temple) in front of the ear of the user 1. The speaker unit 120R and the vibration unit 130R are connected to the headband portion 140. Although not illustrated in FIG. 6 and FIG. 7, the speaker unit 120L is assumed to be worn on the left ear of the user 1, and the vibration unit 130L is assumed to be worn on a portion (for example, near the temple) in front of the ear of the user 1.

The signal generating unit 110 performs a process of delaying the sound output from the speaker units 120R and 120L to be a predetermined time later than the sound output from the vibration units 130R and 130L. As illustrated in FIG. 6, by delaying the sound output from the speaker units 120R and 120L to be a predetermined time later than the sound output from the vibration units 130R and 130L in the state in which the headphone system 100 is worn by the user 1, the headphone system 100 can localize the audio image outside the head of the user 1, for example, at a position indicated by a reference numeral 2A in FIG. 6.

The signal generating unit 110 may generate a bone conduction signal convoluted with a coefficient for localizing the audio image above the user 1. As illustrated in FIG. 7, by generating the bone conduction signal convoluted with the coefficient for localizing the audio image above the user 1 and transmitting the signal to the speaker unit and the vibration unit in the state in which the headphone system 100 is worn by the user 1, the headphone system 100 can localize the audio image outside the head of the user 1, for example, at a position indicated by a reference numeral 2C in FIG. 7.

As described above, the signal generating unit 110 may perform the above-described delay process and the process of generating the bone conduction signal convoluted with the coefficient in combination with each other. By combining the delay process and the process of generating the bone conduction signal convoluted with the coefficient, the audio image can be localized above or below the user 1 as well as in front of and behind the user 1 as illustrated in FIG. 7.

Figure 8:
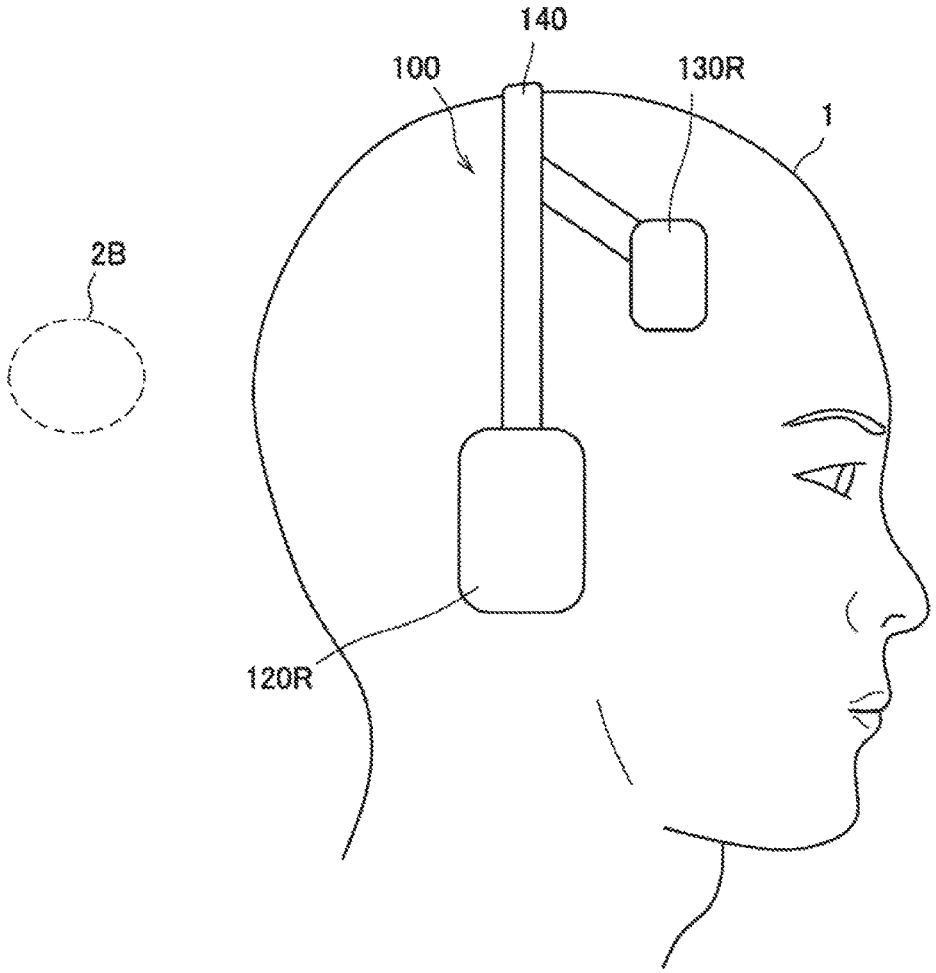
FIG. 8 is an explanatory diagram schematically illustrating a state in which the headphone system 100 is worn by the user 1 when the user 1 is viewed from the right.
Figure 9:
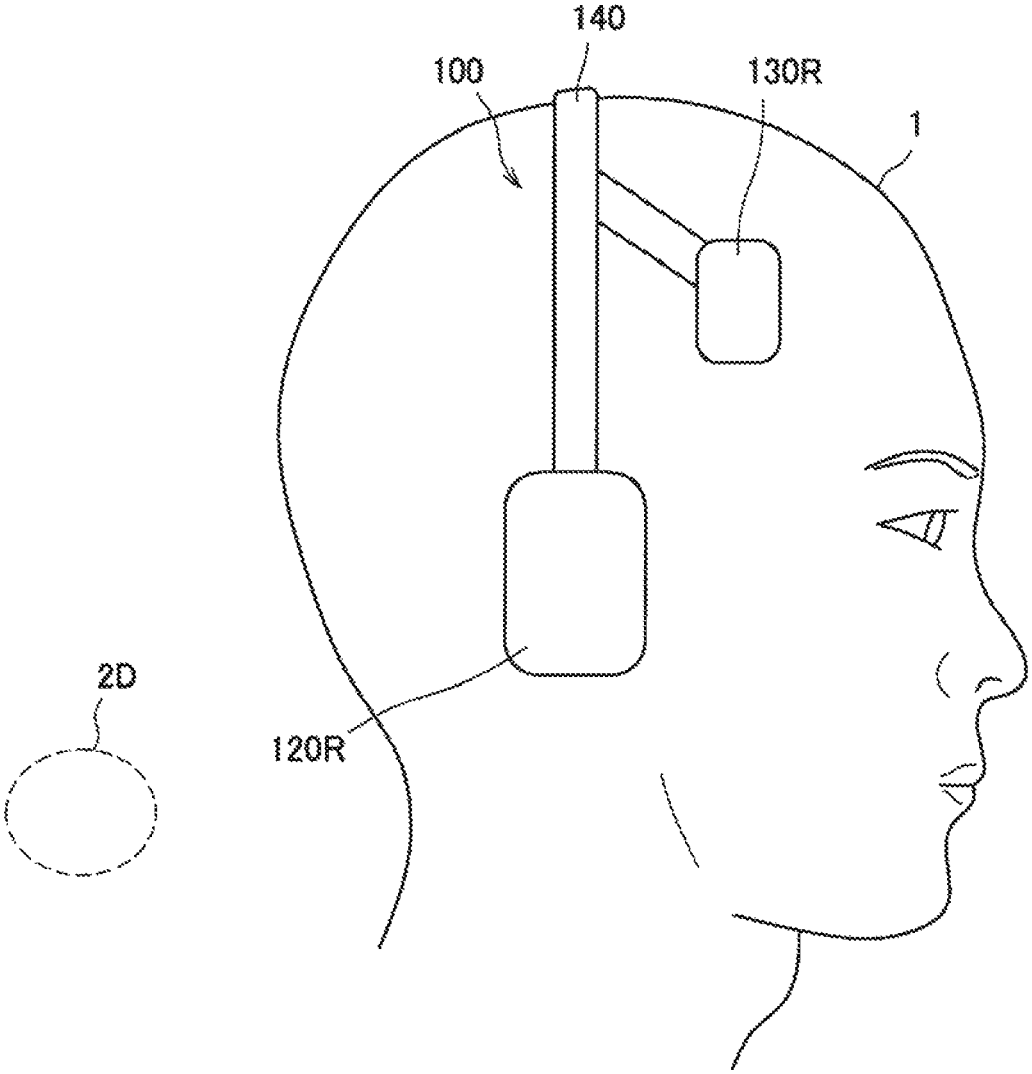
FIG. 9 is an explanatory diagram schematically illustrating a state in which the headphone system 100 is worn by the user 1 when the user 1 is viewed from the right.

Another example of audio image localization by the speaker unit 120 and the vibration unit 130 will be described. FIGS. 8 and 9 are explanatory diagrams schematically illustrating a state in which the headphone system 100 is worn by the user 1 when the user 1 is viewed from the right. FIGS. 8 and 9 schematically illustrate a state in which the speaker unit 120R is worn on the right ear of the user 1, and the vibration unit 130 is worn on a portion (for example, near the temple) in front of the ear of the user 1. The speaker unit 120R and the vibration unit 130R are connected to the headband portion 140. Although not illustrated in FIGS. 8 and 9, the speaker unit 120L is assumed to be worn on the left ear of the user 1, and the vibration unit 130L is assumed to be worn on a portion (for example, near the temple) in front of the ear of the user 1.

The signal generating unit 110 performs a process of delaying the sound output from the vibration units 130R and 130L to be a predetermined time later than the sound output from the speaker units 120R and 120L. As illustrated in FIG. 8, by delaying the sound output from the vibration units 130R and 130L to be a predetermined time later than the sound output from the speaker units 120R and 120L in the state in which the headphone system 100 is worn by the user 1, the headphone system 100 can localize the audio image outside the head of the user 1, for example, at a position indicated by a reference numeral 2B in FIG. 8.

The signal generating unit 110 may generate a bone conduction signal convoluted with a coefficient for localizing the audio image behind and below the user 1. As illustrated in FIG. 9, by generating the bone conduction signal convoluted with the coefficient for localizing the audio image above the user 1 and transmitting the signal to the speaker unit and the vibration unit in the state in which the headphone system 100 is worn by the user 1, the headphone system 100 can localize the audio image behind and below the user 1 outside the head of the user 1, for example, at a position indicated by a reference numeral 2D in FIG. 9.

In the above examples, the 2-channel stereophonic audio signal has been described as the audio signal output from the audio device 10 to the headphone system 100. Next, an example in which the audio signal output from the audio device 10 to the headphone system 100 is an audio signal having a strength difference, for example, the 5.1- or 7.1-channel surround audio signal or the like will be described.

Figure 10:
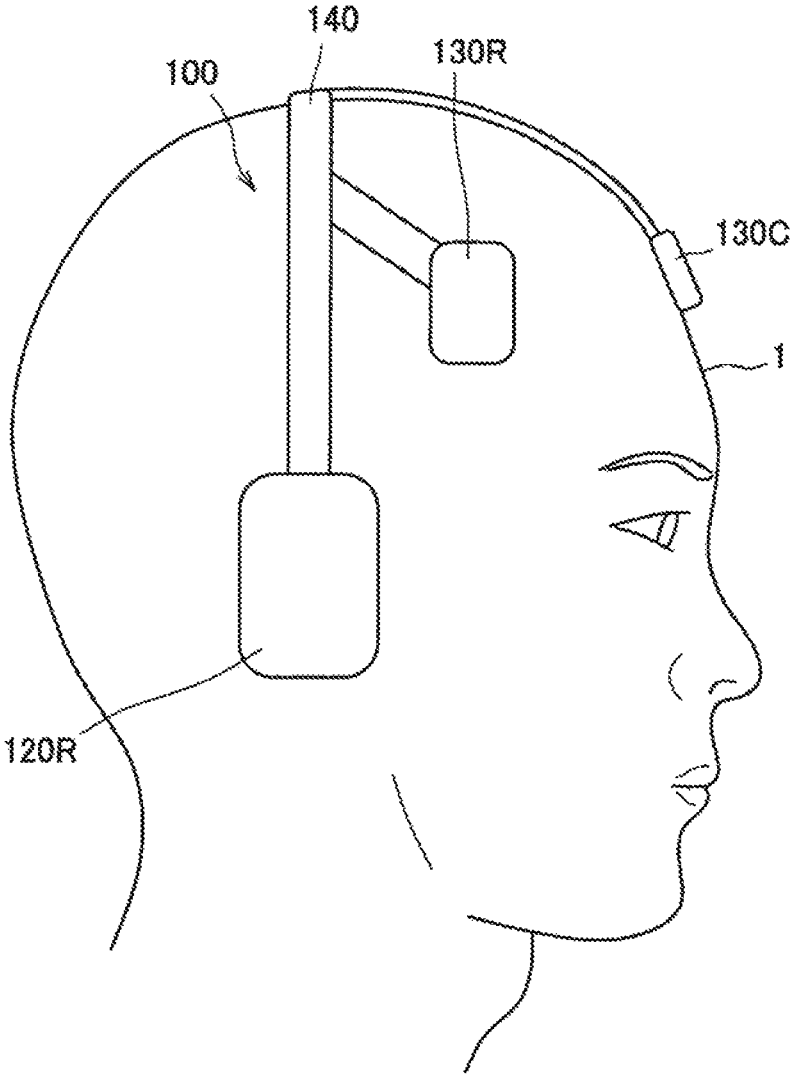
FIG. 10 is an explanatory diagram schematically illustrating a state in which the headphone system 100 is worn by the user 1 when the user 1 is viewed from the right.

FIG. 10 is an explanatory diagram schematically illustrating a state in which the headphone system 100 is worn by the user 1 when the user 1 is viewed from the right. FIG. 10 schematically illustrates a state in which the speaker unit 120R is worn on the right ear of the user 1, the vibration unit 130R is worn on a portion (for example, near the temple) in front of the ear of the user 1, and a vibration unit 130C is further worn on a portion near the forehead of the user. The speaker unit 120R and the vibration units 130R and 130C are connected to the headband portion 140. Although not illustrated in FIG. 10, the speaker unit 120L is assumed to be worn on the left ear of the user 1, and the vibration unit 130L is assumed to be worn on a portion (for example, near the temple) in front of the ear of the user 1.

As described above, when the audio signal supplied from the audio device 10 is the audio signal having the strength difference, for example, the 5.1- or 7.1-channel surround audio signal or the like, the air conduction signal generating unit 111 and the bone conduction signal generating unit 112 can generate the signals so that the 5.1- or 7.1-channel surround audio or the like is implemented through the sounds provided from the speaker unit 120 and the vibration unit 130. Thus, when the headphone system 100 is configured with the speaker unit 120 and the vibration unit 130 illustrated in FIG. 10, the headphone system 100 can implement the surround audio by supplying the signals of the respective channels to the speaker unit 120 and the vibration unit 130.

For example, when the 5.1-channel surround audio signal is supplied from the audio device 10, the air conduction signal generating unit 111 and the bone conduction signal generating unit 112 generate the signals so that a signal of one channel is supplied to each of two speaker units 120 and three vibration units 130. For example, when the headphone system 100 includes the two speaker units 120 and the three vibration units 130 as illustrated in FIG. 10, the air conduction signal generating unit 111 and the bone conduction signal generating unit 112 generate the signals so that a center channel is output from the vibration unit 130C, a front channel is output from the vibration units 130R and 130L, and a rear channel is output from the speaker units 120R and 120L. An LFE channel is supplied to the two speaker units 120R and 120L through the air conduction signal generating unit 111. The air conduction signal generating unit 111 and the bone conduction signal generating unit 112 generate the signals as described above, and thus the headphone system 100 according to the present embodiment can provide the user 1 with the 5.1-channel surround audio.

When the number of vibration units 130 is increased, the headphone system 100 according to the present embodiment can provide the user with the surround audio based on the surround audio signal of more channels.

Figure 11:
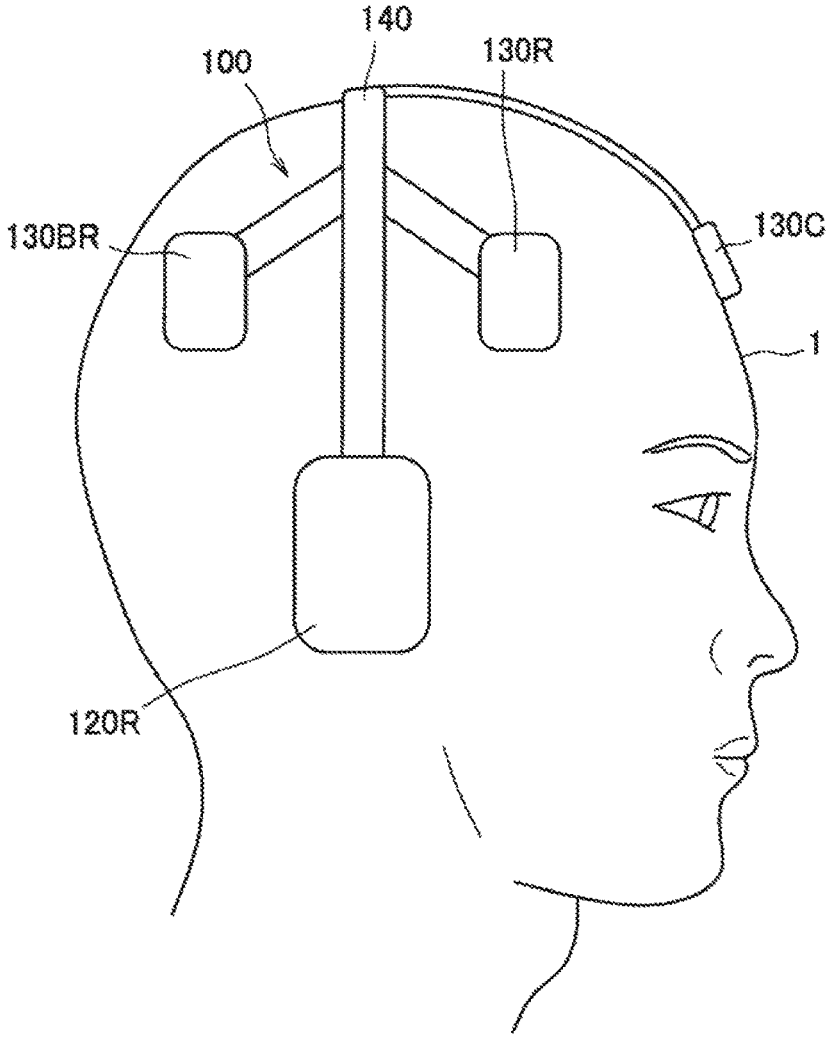
FIG. 11 is an explanatory diagram schematically illustrating a state in which the headphone system 100 is worn by the user 1 when the user 1 is viewed from the right.

FIG. 11 is an explanatory diagram schematically illustrating a state in which the headphone system 100 is worn by the user 1 when the user 1 is viewed from the right. FIG. 11 schematically illustrates a state in which the speaker unit 120R is worn on the right ear of the user 1, the vibration unit 130R is worn on a portion (for example, near the temple) in front of the ear of the user 1, a vibration unit 130BR is worn on a portion behind the ear of the user, and the vibration unit 130C is further worn on a portion near the forehead of the user. The speaker unit 120R and the vibration units 130R, 130BR, and 130C are connected to the headband portion 140. Although not illustrated in FIG. 10, the speaker unit 120L is assumed to be worn on the left ear of the user 1, the vibration unit 130L is assumed to be worn on a portion (for example, near the temple) in front of the ear of the user 1, and the vibration unit 130BL is assumed to be worn on a portion behind the ear of the user 1.

When the 7.1-channel surround audio signal is supplied from the audio device 10, the air conduction signal generating unit 111 and the bone conduction signal generating unit 112 generate the signals so that a signal of one channel is supplied to each of two speaker units 120 and five vibration units 130. For example, when the headphone system 100 includes the two speaker units 120 and the five vibration units 130 as illustrated in FIG. 11, the air conduction signal generating unit 111 and the bone conduction signal generating unit 112 generate the signals so that a center channel is output from the vibration unit 130C, a front channel is output from the vibration units 130R and 130L, a side channel is output from the speaker units 120R and 120L, and a rear channel is output from the vibration units 130BR and 130BL. An LFE channel is supplied to the two speaker units 120R and 120L through the air conduction signal generating unit 111. The air conduction signal generating unit 111 and the bone conduction signal generating unit 112 generate the signals as described above, and thus the headphone system 100 according to the present embodiment can provide the user 1 with the 7.1-channel surround audio.

The above embodiment has been described in connection with the example in which the number of vibration units 130 is three or more, and the surround audio signal is supplied from the audio device 10 to the headphone system 100, but the present disclosure is not limited to this example. When the number of vibration units 130 is one or two and the surround audio signal is supplied from the audio device 10 to the headphone system 100, the air conduction signal generating unit 111 and the bone conduction signal generating unit 112 generate the signal to be supplied to the speaker unit 120 and the vibration unit 130. At this time, the air conduction signal generating unit 111 and the bone conduction signal generating unit 112 generate the signals capable of reproducing an acoustic field intended by the surround audio signal supplied from the audio device 10 through the sounds provided from the speaker unit 120 and the vibration unit 130. Further, when the number of channels of the surround audio signal is not identical to the number of speakers, signal processing is not limited to a specific method.

For example, in the headphone system 100 in which only one vibration unit 130 is installed as illustrated in FIG. 4, the 5.1-channel surround audio signal in which the sound source is in front of the user on the right may be supplied from the audio device 10 to the headphone system 100. In this case, the air conduction signal generating unit 111 and the bone conduction signal generating unit 112 generate signals of three channels to be supplied to the speaker unit 120 and the vibration unit 130 from the 5.1-channel surround audio signal so that the sound is heard from the sound source in front of the user 1 on the right.

When the signals of three channels to be supplied to the speaker unit 120 and the vibration unit 130 are generated from the 5.1-channel surround audio signal, the air conduction signal generating unit 111 and the bone conduction signal generating unit 112 may perform the process of delaying the sound output from the speaker unit 120 to be a predetermined time later than the sound output from the vibration unit 130. By performing the delay process, the headphone system 100 can provide the sound through the speaker unit 120 and the vibration unit 130 so that the audio image is localized outside the head of the user 1 as described above.

In the above examples, when the user 1 wears the headphone system 100, the vibration unit 130 is positioned above the ear of the user 1, but the present disclosure is not limited to this example. For example, when the user 1 wears the headphone system 100, the vibration unit 130 may be positioned below the ear of the user, for example, near the jaw or the back of the neck.

Figure 12:
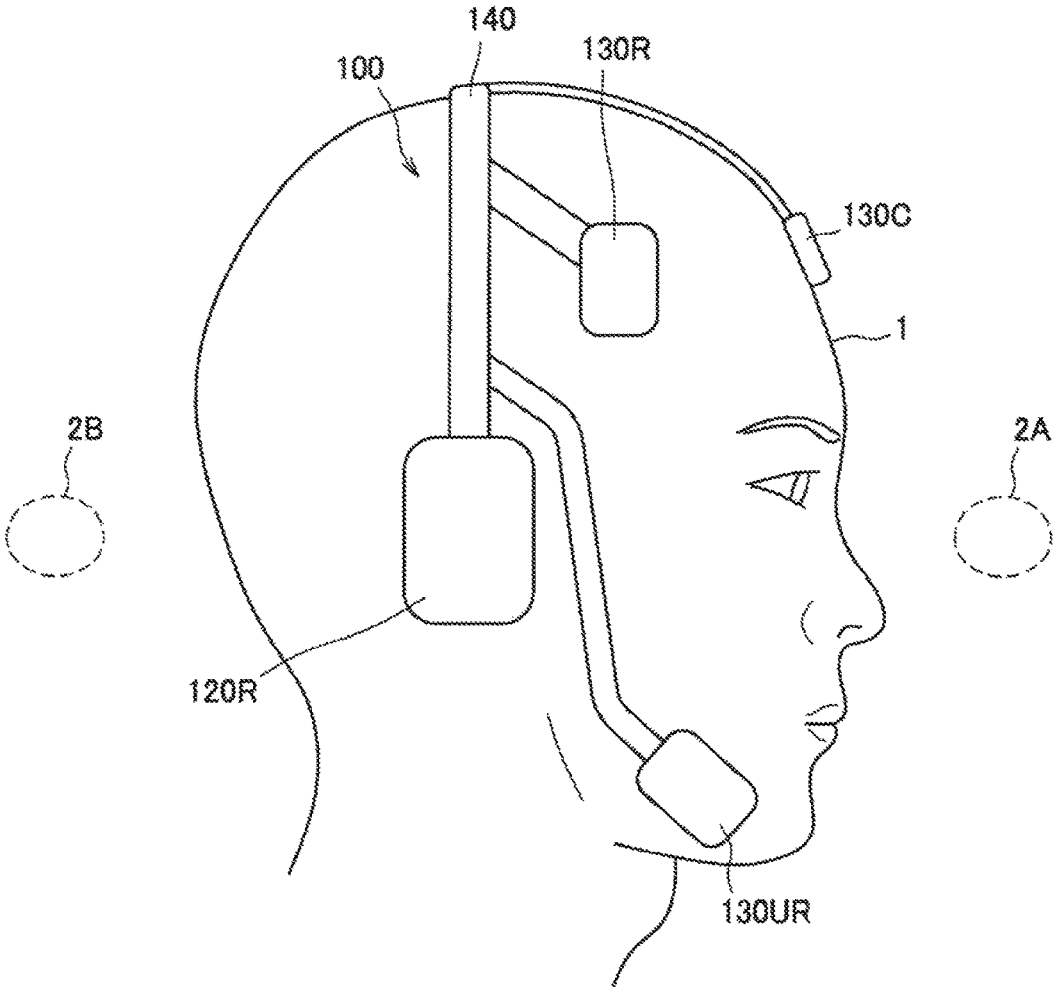
FIG. 12 is an explanatory diagram schematically illustrating a state in which the headphone system 100 is worn by the user 1 when the user 1 is viewed from the right.

FIG. 12 is an explanatory diagram schematically illustrating a state in which the headphone system 100 is worn by the user 1 when the user 1 is viewed from the right. FIG. 11 illustrates a state in which the speaker unit 120R is worn on the right ear of the user 1, the vibration unit 130R is worn on a portion (for example, near the temple) in front of the ear of the user 1, the vibration unit 130C is worn on a portion near the forehead of the user, and the vibration unit 130UR is further worn on a portion near the jaw of the user.

Figure 13:
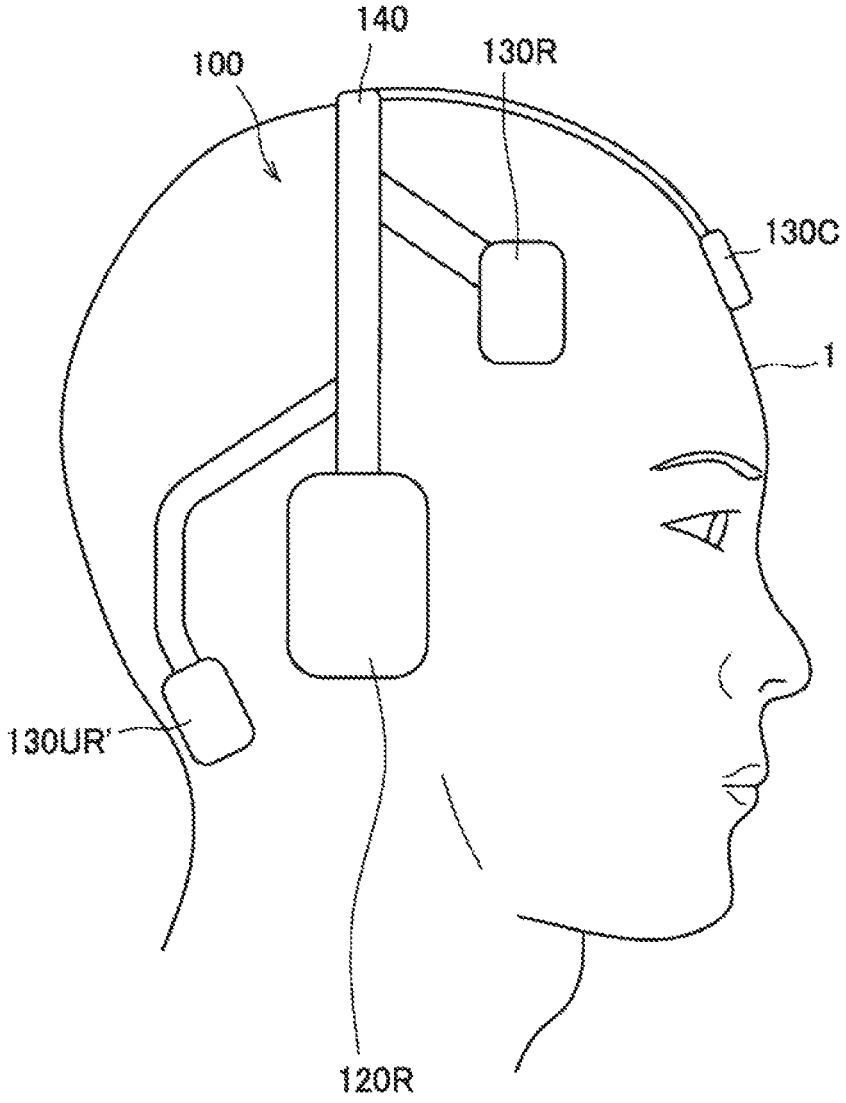
FIG. 13 is an explanatory diagram schematically illustrating a state in which the headphone system 100 is worn by the user 1 when the user 1 is viewed from the right.

FIG. 13 is an explanatory diagram schematically illustrating a state in which the headphone system 100 is worn by the user 1 when the user 1 is viewed from the right. FIG. 13 illustrates a state in which the speaker unit 120R is worn on the right ear of the user 1, the vibration unit 130R is worn on a portion (for example, near the temple) in front of the ear of the user 1, the vibration unit 130C is worn on a portion near the forehead of the user, and a vibration unit 130UR' is further worn on a portion behind the ear of the user, for example, near the back of the neck.

As illustrated in FIGS. 12 and 13, when the user 1 wears the headphone system 100, the vibration unit 130 may be positioned below the ear of the user, for example, the jaw or a portion behind the ear (for example, near the back of the neck). By outputting the sounds from the speaker units and the vibration units as in the above examples, the headphone system 100 can localize the audio image outside the head of the user 1, that is, in front of, behind, above, and below the user 1.

2. Conclusion

As described above, according to the embodiment of the present disclosure, the headphone system 100 that transfers sounds having different paths such as the air conduction sound and the bone conduction sound is provided. Further, according to the embodiment of the present disclosure, the headphone system 100 capable of causing a sound to be provided to have a back and forth or up and down positional relation by transferring sounds having different paths such as the air conduction sound and the bone conduction sound to the user with a time difference, a strength difference, and a spectrum difference is provided. The headphone system 100 according to an embodiment of the present disclosure transfers the air conduction sound and the bone conduction sound to the user with the time difference or the strength difference and localizes the audio image outside the head of the user, and thus a more natural stereophonic sound giving a realistic sensation can be reproduced.

In the headphone system 100 according to an embodiment of the present disclosure, the audio image can be easily localized outside the head of the user by positioning the vibration unit to be worn at a position some distance away from the ear on which the speaker unit is worn.

Further, the headphone system 100 according to an embodiment of the present disclosure can reproduce a more natural stereophonic sound giving a realistic sensation regardless of the influence of individual differences in the shapes of ears or heads or an imperfection in the recording system or the reproducing system, by transferring the air conduction sound and the bone conduction sound to the user with the time difference or the strength difference.

Moreover, the headphone system 100 according to an embodiment of the present disclosure can reproduce a more natural stereophonic sound giving a realistic sensation by allocating the channels of the surround audio to the speaker unit 120 that provides the air conduction sound and the vibration unit 130 that provides the bone conduction sound.

Further, a computer program can be created which causes hardware such as a CPU, ROM, or RAM, incorporated in each of the devices, to function in a manner similar to that of structures in the above-described devices. Furthermore, it is possible to provide a recording medium having the computer program recorded thereon. Moreover, by configuring respective functional blocks shown in a functional block diagram as hardware, the hardware can achieve a series of processes.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

In addition, the effects described in the present specification are merely illustrative and demonstrative, and not limitative. In other words, the technology according to the present disclosure can exhibit other effects that are evident to those skilled in the art along with or instead of the effects based on the present specification.

Additionally, the present technology may also be configured as below.

(1)

An acoustic output device, including:

an air conduction sound providing unit configured to provide an air conduction sound; and a bone conduction sound providing unit configured to provide a bone conduction sound, wherein the bone conduction sound providing unit is positioned on a portion other than near an ear of a user when worn by the user.

(2)

The acoustic output device according to (1), wherein output timings of an audio signal supplied to the bone conduction sound providing unit and an audio signal supplied to the air conduction sound providing unit are adjusted and supplied.

(3)

The acoustic output device according to (2), wherein the audio signal supplied to the bone conduction sound providing unit is delayed to be a predetermined time later than the audio signal supplied to the air conduction sound providing unit.

(4)

The acoustic output device according to any of (1) to (3), wherein the bone conduction sound providing unit is installed at left and right mounting positions of a head of the user.

(5)

The acoustic output device according to (4), wherein the audio signal supplied to the bone conduction sound providing unit is a signal providing a pseudo three-dimensional sound.

(6)

The acoustic output device according to (5), wherein the air conduction sound providing unit is worn on left and right ears of the user, and audio signals of two channels among audio signals of a plurality of channels are supplied to the air conduction sound providing unit, and audio signals of the other channels are supplied to the bone conduction sound providing unit.

(7)

The acoustic output device according to any of (1) to (6), wherein an audio image provided by the air conduction sound providing unit and the bone conduction sound providing unit is localized outside the head of the user.

(8)

The acoustic output device according to (7), wherein the audio image provided by the air conduction sound providing unit and the bone conduction sound providing unit is localized in front of the user.

(9)

The acoustic output device according to (7), wherein the audio image provided by the air conduction sound providing unit and the bone conduction sound providing unit is localized behind the user.

(10)

The acoustic output device according to (7), wherein the audio image provided by the air conduction sound providing unit and the bone conduction sound providing unit is localized above the user.

(11)

The acoustic output device according to (7), wherein the audio image provided by the air conduction sound providing unit and the bone conduction sound providing unit is localized below the user.

REFERENCE SIGNS LIST

100 headphone system
110 signal generating unit
111 air conduction signal generating unit
112 bone conduction signal generating unit
120 speaker unit
130 vibration unit

The invention claimed is:

1. An acoustic output device, comprising:

an air conduction sound providing unit configured to output an air conduction sound;

a bone conduction sound providing unit configured to output a bone conduction sound, wherein the bone conduction sound providing unit is positioned on a portion other than near an ear of a user when worn by the user; and a signal generating unit configured to generate a bone conduction signal and supply the bone conduction signal to the bone conduction sound providing unit, wherein the bone conduction signal is convoluted with coefficients to localize an audio image.

2. The acoustic output device according to claim 1, wherein the signal generating unit is further configured to adjust and supply output timings of a first audio signal supplied to the bone conduction sound providing unit and a second audio signal supplied to the air conduction sound providing unit to localize the audio image at a first position.

3. The acoustic output device according to claim 2, wherein the signal generating unit is further configured to delay the first audio signal supplied to the bone conduction sound providing unit by a determined time later than the second audio signal supplied to the air conduction sound providing unit.

4. The acoustic output device according to claim 2, wherein the first audio signal supplied to the bone conduction sound providing unit is a signal that generates a pseudo three-dimensional sound.

5. The acoustic output device according to claim 4, wherein the air conduction sound providing unit is worn on a left ear and a right ear of the user, and wherein the signal generating unit is further configured to supply audio signals of two channels among audio signals of a plurality of channels to the air conduction sound providing unit, and supply the audio signals of remaining channels of the plurality of channels to the bone conduction sound providing unit.

6. The acoustic output device according to claim 2, wherein the signal generating unit is further configured to delay the second audio signal supplied to the air conduction sound providing unit by a determined time than the first audio signal supplied to the bone conduction sound providing unit to localize the audio image at a second position.

7. The acoustic output device according to claim 1, wherein the bone conduction sound providing unit is installed at left mounting position and a right mounting position of a head of the user.

8. The acoustic output device according to claim 1, wherein the audio image by the air conduction sound providing unit and the bone conduction sound providing unit is localized outside a head of the user.

9. The acoustic output device according to claim 8, wherein the audio image by the air conduction sound providing unit and the bone conduction sound providing unit is localized in front of the user.

10. The acoustic output device according to claim 8, wherein the audio image by the air conduction sound providing unit and the bone conduction sound providing unit is localized behind the user.

11. The acoustic output device according to claim 8, wherein the audio image by the air conduction sound providing unit and the bone conduction sound providing unit is localized above the user.

12. The acoustic output device according to claim 8, wherein the audio image by the air conduction sound providing unit and the bone conduction sound providing unit is localized below the user.

13. The acoustic output device according to claim 1, wherein the coefficients are set based on an impulse response from a sound source to a left ear and a right ear of the user.

14. The acoustic output device according to claim 1, wherein the air conduction sound has at least one of a time difference, a strength difference or a spectrum difference with respect to the bone conduction sound.

15. An acoustic output method, comprising:

outputting, by an air conduction sound providing unit, an air conduction sound;

outputting, by a bone conduction sound providing unit, a bone conduction sound, wherein the bone conduction sound providing unit is positioned on a portion other than near an ear of a user when worn by the user; and generating a bone conduction signal and supplying the bone conduction signal to the bone conduction sound providing unit, wherein the bone conduction signal is convoluted with coefficients to localize an audio image.

* * * * *